US011145968B2

(12) United States Patent
Wang et al.

(10) Patent No.: US 11,145,968 B2
(45) Date of Patent: Oct. 12, 2021

(54) ARRAY ANTENNA AND SECTOR ANTENNA

(71) Applicant: NIHON DENGYO KOSAKU CO., LTD., Tokyo (JP)

(72) Inventors: Lin Wang, Tokyo (JP); Cheng Yang, Tokyo (JP)

(73) Assignee: NIHON DENGYO KOSAKU CO., LTD., Tokyo (JP)

( * ) Notice: Subject to any disclaimer, the term of this patent is extended or adjusted under 35 U.S.C. 154(b) by 105 days.

(21) Appl. No.: 16/497,799

(22) PCT Filed: Mar. 29, 2017

(86) PCT No.: PCT/JP2017/012988
§ 371 (c)(1),
(2) Date: Sep. 26, 2019

(87) PCT Pub. No.: WO2018/179160
PCT Pub. Date: Oct. 4, 2018

(65) Prior Publication Data

US 2021/0126357 A1 Apr. 29, 2021

(51) Int. Cl.
*H01Q 21/26* (2006.01)
*H01Q 1/52* (2006.01)
(Continued)

(52) U.S. Cl.
CPC ..... *H01Q 1/523* (2013.01); *H01Q 1/246* (2013.01); *H01Q 21/062* (2013.01);
(Continued)

(58) Field of Classification Search
CPC .... H01Q 21/26; H01Q 21/245; H01Q 21/246; H01Q 9/16; H01Q 21/0006; H01Q 1/22; H01Q 15/14; H01Q 5/35
(Continued)

(56) References Cited

U.S. PATENT DOCUMENTS 5,039,994 A 8/1991 Wash et al.
6,025,812 A 2/2000 Gabriel et al.
(Continued)

FOREIGN PATENT DOCUMENTS

CN 1391712 1/2003
CN 105140629 12/2015
(Continued)

OTHER PUBLICATIONS

"International Search Report (Form PCT/ISA/210)" of PCT/JP2017/012988, dated May 23, 2017, with English translation thereof, pp. 1-4.
(Continued)

*Primary Examiner* — Joseph J Lauture
(74) *Attorney, Agent, or Firm* — JCIPRNET

(57) ABSTRACT

An array antenna is provided with: a first conductive member including a planar part; plural antennas arranged at a predetermined first interval to the planar part of the first conductive member, each of the plural antennas transmitting and receiving radio frequencies of a first polarization and radio frequencies of a second polarization that is different from the first polarization; and a second conductive member provided between the antennas adjacent to each other among the plural antennas via a gap of a predetermined second interval to the planar part of the first conductive member, the second conductive member being capacitively coupled to the first conductive member.

18 Claims, 5 Drawing Sheets

(51) Int. Cl.

| | |
|---|---|
| ***H01Q 1/24*** | (2006.01) |
| ***H01Q 21/06*** | (2006.01) |
| *H01Q 1/42* | (2006.01) |
| *H01Q 15/14* | (2006.01) |
| *H01Q 9/16* | (2006.01) |
| *H01Q 1/22* | (2006.01) |
| *H01Q 21/00* | (2006.01) |

(52) U.S. Cl.
CPC ..... *H01Q 21/26* (2013.01); *H01Q 1/22* (2013.01); *H01Q 1/42* (2013.01); *H01Q 9/16* (2013.01); *H01Q 15/14* (2013.01); *H01Q 21/0006* (2013.01)

(58) Field of Classification Search
USPC ..... 343/797, 702, 793, 843, 853; 33/833
See application file for complete search history.

(56) References Cited

U.S. PATENT DOCUMENTS

| | | | | |
|---|---|---|---|---|
| 6,195,063 | B1 | 2/2001 | Gabriel et al. | |
| 6,542,131 | B1 | 4/2003 | Haapanen | |
| 6,734,829 | B1 | 5/2004 | Gottl | |
| 2004/0201542 | A1 | 10/2004 | Gottl et al. | |
| 2008/0272976 | A1* | 11/2008 | Kitamori | H01Q 9/285 343/793 |
| 2012/0313827 | A1* | 12/2012 | Kim | H01Q 1/38 343/702 |
| 2013/0271336 | A1 | 10/2013 | Plet et al. | |
| 2015/0263435 | A1* | 9/2015 | Song | H01Q 25/001 343/810 |

FOREIGN PATENT DOCUMENTS

| | | |
|---|---|---|
| CN | 106450751 | 2/2017 |
| CN | 205921070 | 2/2017 |
| JP | 2002538648 | 11/2002 |
| JP | 2003504925 | 2/2003 |
| JP | 2006-121406 | 5/2006 |
| JP | 2006217104 | 8/2006 |
| JP | 2015167337 | 9/2015 |
| WO | 2004091042 | 10/2004 |

OTHER PUBLICATIONS

Li Ming., "Application of Wideband Base-Station Antenna for LTE Communication System", State Key Laboratory of Millimeter Waves School of Information Science and Engineering Southeast University, May 2015, pp. 1-74.

* cited by examiner

ARRAY ANTENNA AND SECTOR ANTENNA

CROSS-REFERENCE TO RELATED APPLICATION

This application is a 371 application of the international PCT application serial no. PCT/JP2017/012988, filed on Mar. 29, 2017. The entirety of the abovementioned patent applications is hereby incorporated by reference herein and made a part of this specification.

TECHNICAL FIELD

The present invention relates to an array antenna and a sector antenna.

BACKGROUND ART

For a base station antenna of mobile communications, plural sector antennas, each of which radiates radio frequencies in each sector (region) set in accordance with a direction in which the radio frequencies are radiated, are used in combination. As the sector antenna, an array antenna in which radiation elements (antenna elements), such as dipole antennas, are arranged in an array shape is used.

In Patent Literature 1, there is described an antenna including: a dielectric substrate; plural patch antenna elements prepared on one surface of the dielectric substrate in a matrix shape; a ground electrode arranged on the other surface of the dielectric substrate; and a conductive partition wall arranged between the patch antenna elements, the partition wall being electrically connected to the ground electrode.

In Patent Literature 2, a reflector module produced by using a casting method, deep-drawing or stamping method with two longitudinal walls and at least one transverse wall is described.

CITATION LIST

Patent Literature

Patent Literature 1: Japanese Patent Application Laid-Open Publication No. 2006-121406

Patent Literature 2: International Publication No. WO 2004/091042

SUMMARY

Technical Problem

By the way, for the array antenna, a dual polarization antenna capable of transmitting and receiving polarizations different from one another is used in some cases for a purpose of improving a communication quality and increasing a channel capacity of the sector antenna. Then, it is required that the polarization coupling amounts among the antennas transmitting and receiving the polarizations are kept low over the wide band. At the same time, it is also required that occurrence of intermodulation distortion or white noise is kept low.

An object of the present invention is to provide a dual polarization array antenna or the like capable of keeping occurrence of the intermodulation distortion or white noise low while reducing the polarization coupling amounts among antennas transmitting and receiving polarizations different from one another.

Solution to Problem

Under such an object, an array antenna to which the present invention is applied includes: a first conductive member including a planar part; plural antennas arranged at a predetermined first interval to the planar part of the first conductive member, each of the plural antennas transmitting and receiving radio frequencies of a first polarization and radio frequencies of a second polarization that is different from the first polarization; and a second conductive member provided between the antennas adjacent to each other among the plural antennas via a gap of a predetermined second interval to the planar part of the first conductive member, the second conductive member being capacitively coupled to the first conductive member.

In such an array antenna, the second conductive member includes: a partition part including a plane included in a virtual flat plane that intersects the planar part of the first conductive member; and a coupling part including a plane facing the planar part of the first conductive member via the gap of the predetermined second interval. This makes it possible to increase the coupling amount in the coupling part.

Moreover, in the second conductive member, the coupling part is provided closer to the first conductive member than the partition part. This makes it possible to further increase the coupling amount in the coupling part.

Further, in the second conductive member, the coupling part and the partition part are configured by bending a conductive material. This makes it possible to configure the second conductive member with ease.

Still further, the first conductive member includes, on a side intersecting a direction of arrangement of the plural antennas arranged at the predetermined first interval to the planar part, standing parts standing from the planar part toward a side where the plural antennas are arranged, and the second conductive member includes, at end portions of the partition part, connecting parts that face the standing parts of the first conductive member, the connecting parts of the second conductive member being fastened to the standing parts of the first conductive member via an insulator material. This makes it possible to further suppress occurrence of the intermodulation distortion or the white noise.

Then, the radio frequencies transmitted and received by the plural antennas are polarization of +45° direction and polarization of −45° direction with respect to the arrangement of the plural antennas. This makes it possible to suppress the polarization coupling amount more effectively.

Moreover, from another standpoint, a sector antenna to which the present invention is applied includes: an array antenna including a first conductive member including a planar part, plural antennas arranged at a predetermined first interval to the planar part of the first conductive member, each of the plural antennas transmitting and receiving radio frequencies of a first polarization and radio frequencies of a second polarization that is different from the first polarization, a circuit that distributes and combines power for the plural antennas, and a second conductive member provided between the antennas adjacent to each other among the plural antennas via a gap of a predetermined second interval to the planar part of the first conductive member, the second conductive member being capacitively coupled to the first conductive member; and a cover that covers the array antenna.

Advantageous Effects of Invention

According to the present invention, it is possible to provide a dual polarization array antenna or the like capable of keeping occurrence of the intermodulation distortion or white noise low while reducing the polarization coupling amounts among antennas transmitting and receiving polarizations different from one another.

BRIEF DESCRIPTION OF DRAWINGS

FIG. 1A is a perspective view of the base station antenna; and FIG. 1B is a diagram illustrating an installation example of the base station antenna;

FIG. 2A is an elevational view of the array antenna (the x-y plane view); and FIG. 2B is a cross-sectional view of the array antenna along the IIB-IIB line in FIG. 2A (the x-z plane view);

FIG. 3A is an elevational view from the z direction; and FIG. 3B is a side view from the y direction;

FIG. 4A shows the polarization coupling amount in the first exemplary embodiment; and FIG. 4B shows the polarization coupling amount when the first exemplary embodiment is not adopted, and thereby the partition plate is not provided with a coupling part.

FIG. 5A shows a case in which the coupling part is provided in the −y direction side with respect to a partition part; FIG. 5B shows a case in which the coupling part is provided over the +y direction side and the −y direction side with respect to the partition part; and FIG. 5C shows a case in which the coupling part is provided in a semicircular shape in the +y direction with respect to the partition part.

DESCRIPTION OF EMBODIMENTS

Hereinafter, exemplary embodiments according to the present invention will be described in detail with reference to attached drawings.

First Exemplary Embodiment

<Base Station Antenna 1>

Figure 1B:
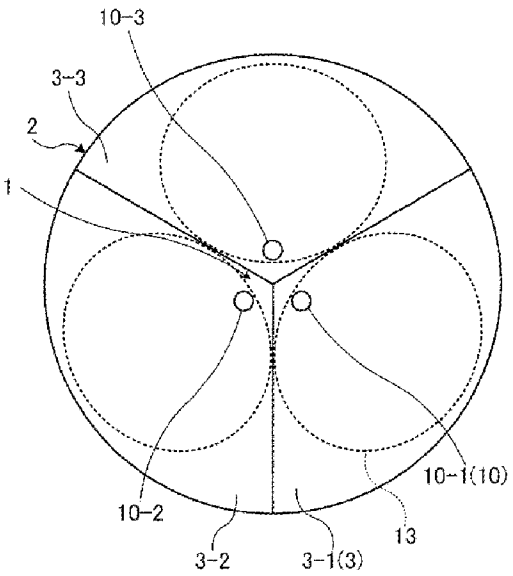
FIG. 1A and FIG. 1B show diagrams depicting an example of an entire configuration of a base station antenna of mobile communications, to which the first exemplary embodiment is applied.
Figure 1A:
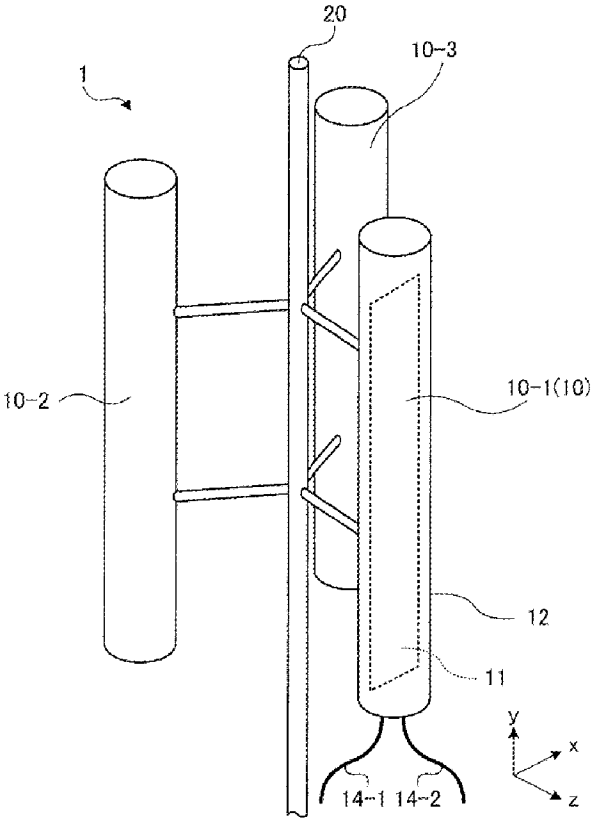

FIG. 1A and FIG. 1B show diagrams depicting an example of an entire configuration of a base station antenna 1 of mobile communications, to which the first exemplary embodiment is applied. FIG. 1A is a perspective view of the base station antenna 1, and FIG. 1B is a diagram illustrating an installation example of the base station antenna 1.

The base station antenna 1 includes, as shown in FIG. 1A, plural sector antennas 10-1 to 10-3 (when not distinguished, referred to as a sector antenna 10) held by, for example, a tower 20. Each of the sector antennas 10-1 to 10-3 includes an array antenna 11. The array antenna 11 is covered with a radome 12 as a cover protecting thereof from wind and rain. In other words, the outside of the sector antennas 10-1 to 10-3 are radomes 12, and inside the radomes 12, the array antennas 11 are contained. Here, the radome 12 is assumed to have a cylindrical shape; however, the radome 12 may be in other shapes. The base station antenna 1 transmits and receives the radio frequencies in a cell 2 shown in FIG. 1B.

Figure 2A:
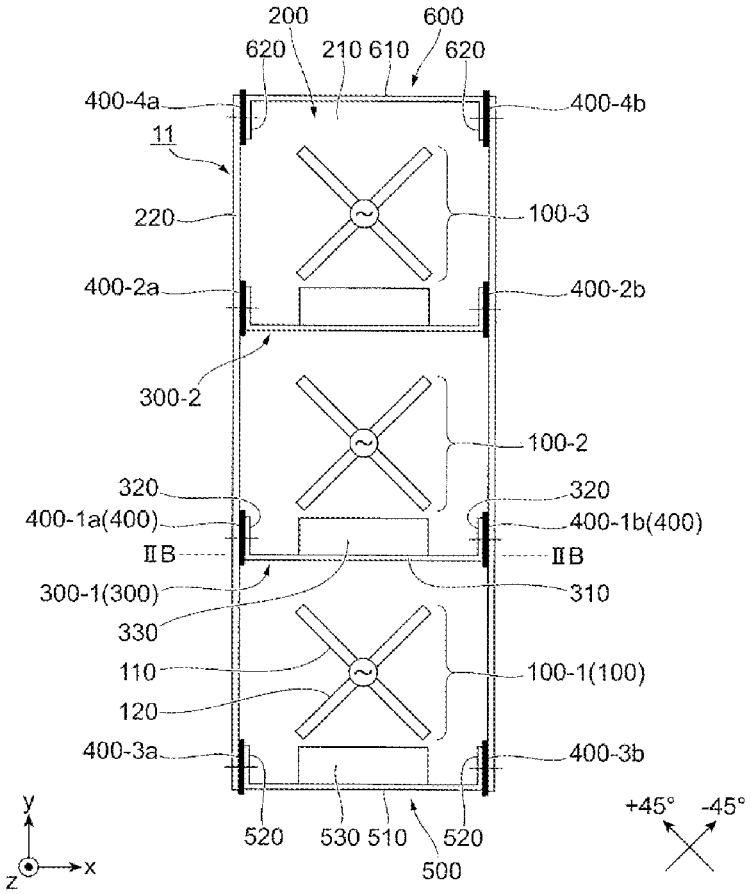
FIG. 2A and FIG. 2B show diagrams depicting an example of a configuration of an array antenna in the first exemplary embodiment.
Figure 2B:
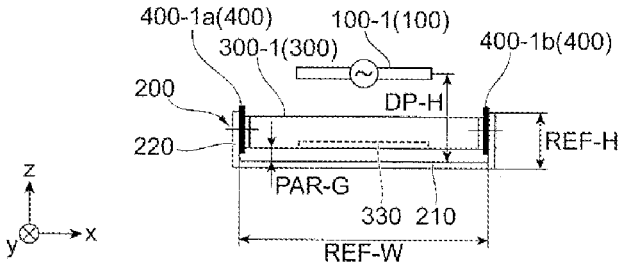

Note that, as shown in FIG. 1A, the x-y-z coordinates are set for the sector antenna 10-1. In other words, the vertical direction is set as the y direction. Then, as shown in FIG. 2A and FIG. 2B to be described later, in the sector antenna 10-1 taken as an example, the x direction is provided along a planar part 210 of a reflector 200, and the z direction is provided orthogonal to the planar part 210 of the reflector 200 in the array antenna 11.

As shown in FIG. 1B, the base station antenna 1 transmits and receives the radio frequencies in the cell 2. The cell 2 is divided into plural sectors 3-1 to 3-3 corresponding to the sector antennas 10-1 to 10-3 (when not distinguished, referred to as a sector 3). Then, each of the sector antennas 10-1 to 10-3 is set so that a main lobe 13 of the radio frequency transmitted from and received by the array antenna 11 faces toward each of the corresponding sectors 3-1 to 3-3.

Note that, in FIG. 1A and FIG. 1B, it is assumed that the base station antenna 1 includes the three sector antennas 10-1 to 10-3 and the sectors 3-1 to 3-3 corresponding thereto. However, the number of the sector antennas 10 and the sectors 3 may be a predetermined number other than three. Moreover, in FIG. 1B, the sector 3 is configured by trisecting the cell 2 (the center angle is 120°); however, the cell 2 does not have to be equally divided, and any one of the sectors 3 may be configured to be narrower or broader than the other sectors 3.

Each sector antenna 10 is connected to transmission/reception cables 14-1 and 14-2 that transfer transmission signals and reception signals to the array antenna 11. Note that, each of the transmission/reception cables 14-1 and 14-2 transfers the transmission signals and reception signals of the radio frequencies of polarizations orthogonal to each other.

The transmission/reception cables 14-1 and 14-2 are connected to a transceiver part (not shown) provided in a base station (not shown), the transceiver part generating the transmission signals and receiving the reception signals. The transmission/reception cables 14-1 and 14-2 are, for example, coaxial cables.

Note that, the base station antenna 1, the sector antenna 10, the array antenna 11 and the like are able to transmit and receive the radio frequencies due to reversibility of antennas.

The sector antenna 10 includes a circuit that distributes and combines power for transmission/reception signals to plural antennas (antennas 100-1, 100-2 and 100-3 in FIG. 2A and FIG. 2B to be described later) provided to the array antenna 11.

Note that, a phase shifter for differentiating phases of the transmission/reception signals among the plural antennas may be included. By differentiating the phases of the transmission/reception signals among the antennas, it is possible to tilt radiation angles of the radio frequencies (beams) toward the ground direction.

<Array Antenna 11>

FIG. 2A and FIG. 2B show diagrams depicting an example of a configuration of the array antenna 11 in the first exemplary embodiment. FIG. 2A is an elevational view of the array antenna 11 (the x-y plane view), and FIG. 2B is a cross-sectional view of the array antenna 11 along the IIB-IIB line in FIG. 2A (the x-z plane view). Here, the array antenna 11 will be described by taking the sector antenna 10-1 shown in FIG. 1A as an example.

The array antenna 11 includes: plural (here, three as an example) antennas 100-1 to 100-3 (when not distinguished, referred to as an antenna 100) each having a cross-dipole structure; the reflector 200; partition plates 300-1 and 300-2 (when not distinguished, referred to as a partition plate 300);

spacers 400-1*a* to 400-4*a* and 400-1*b* to 400-4*b* (when not distinguished, referred to as a spacer 400); and adjusters 500 and 600.

The antennas 100-1 to 100-3 are arranged in the y direction.

Note that, the array antenna 11 is assumed to include the three antennas 100; however, the plural, other than three, antennas 100 may be included.

Here, the reflector 200 is an example of a first conductive member, and the partition plate 300 is an example of a second conductive member.

As shown in the antenna 100-1 in FIG. 2A, the antenna 100 is configured with a dipole antenna 110 that transmits and receives radio frequencies of +45° polarization and a dipole antenna 120 that transmits and receives radio frequencies of −45° polarization, each of which is fed from the center part of the dipole antenna. Though not shown here, a feeding part of each antenna 100 is connected to a distribution/combination circuit or the phase shifter by, for example, a coaxial cable or the like, for each polarization. Then, the distribution/combination circuit, the phase shifter and the like are connected to the transmission/reception cables 14-1 and 14-2 (refer to FIG. 1A).

Here, +45° polarization is an example of a first polarization, and −45° polarization is an example of a second polarization.

Provided with a predetermined interval DP-H from the antenna 100, the reflector 200 is disposed. The reflector 200 is configured with the planar part 210 and two standing parts 220 provided to stand from both ends in the x direction of the planar part 210. In other words, the two standing parts 220 are provided along the antenna 100 arranged in the y direction. Note that, the interval DP-H is an example of a first interval.

Note that, the planar part 210 and the standing parts 220 may be integrally configured by, for example, bending a flat plate, or each of them may be configured by a different member to be coupled by screws or the like. Moreover, the planar part 210 and the standing parts 220 may be capacitively coupled via insulator materials.

The reflector 200 is configured with a conducting material, such as aluminum.

Between the two antennas 100 adjacent to each other in the y direction of the array antenna 11, the partition plates 300-1 and 300-2 are provided.

As shown by the partition plate 300-1, the partition plate 300 includes: a partition part 310 that partitions the two adjacent antennas 100; two connecting parts 320 at both ends of the partition part 310 to be connected to the standing parts 220 of the reflector 200; and a coupling part 330 facing the planar part 210 of the reflector 200.

Here, the partition part 310 of the partition plate 300 includes a plane orthogonal to the planar part 210 of the reflector 200, and the partition part 310 has a rectangular shape extending between the two standing parts 220 of the reflector 200.

The coupling part 330 of the partition plate 300 includes a plane in parallel with the planar part 210 of the reflector 200, and the coupling part 330 has a rectangular shape extending toward the +y direction with respect to the partition part 310. Then, the coupling part 330 of the partition plate 300 and the planar part 210 of the reflector 200 face each other with an interval PAR-G (refer to FIG. 2B). Note that, the interval PAR-G is an example of a second interval.

Moreover, the connecting part 320 of the partition plate 300 has a planar shape that is bent at 90° from the partition part 310.

Note that, the partition part 310 of the partition plate 300 may be an oblique plane with respect to the planar part 210 of the reflector 200, not an orthogonal plane. In other words, the partition part 310 may have a plane included in a virtual flat plane intersecting the planar part 210. Moreover, the coupling part 330 of the partition plate 300 may be an oblique plane with respect to the planar part 210 of the reflector 200, not a parallel plane.

The partition plate 300 is configured with a conducting material, such as aluminum.

In the partition plate 300-1, the two connecting parts 320 are fastened to the standing parts 220 of the reflector 200 by screws or the like with the respective spacers 400-1*a* and 400-1*b* interposed therebetween. In the partition plate 300-2, the two connecting parts 320 are fastened to the standing parts 220 of the reflector 200 by screws or the like with the respective spacers 400-2*a* and 400-2*b* interposed therebetween.

The spacer 400 is composed of, for example, a resin such as glass epoxy or polyacetal, which is the insulator material.

The spacer 400 is provided so that the reflector 200 and the partition plate 300 are not directly connected.

Here, the partition part 310, the connecting parts 320 and the coupling part 330 in the partition plate 300 are continuously provided. In other words, the coupling part 330 is configured by bending an end portion of the partition plate 300 in the −z direction to the +y direction, and the connecting parts 320 are configured by bending end portions of the partition plate 300 in the ±x direction to the +y direction. With the configuration like this, it becomes easy to produce the partition plate 300.

Note that, at the end portion of the reflector 200 in the −y direction, the adjuster 500 in a similar shape as the partition plate 300 is provided. The adjuster 500 includes: a partition part 510 similar to the partition part 310; connecting parts 520 similar to the connecting parts 320; and a coupling part 530 similar to the coupling part 330.

Moreover, at the end portion of the reflector 200 in the +y direction, the adjuster 600 is provided. The adjuster 600 includes: a partition part 610 similar to the partition part 310; and connecting parts 620 bent in the opposite direction of the connecting parts 320 (the −y direction).

Then, similar to the partition plate 300, in the adjuster 500, the connecting parts 520 are connected to the standing parts 220 of the reflector 200 via spacers 400-3*a* and 400-3*b*, and, in the adjuster 600, the connecting parts 620 are connected to the standing parts 220 of the reflector 200 via spacers 400-4*a* and 400-4*b*.

The adjusters 500 and 600 are provided to maintain symmetry in the y direction of the antenna 100. Consequently, the adjusters 500 and 600 may be provided in consideration for effects on the polarization coupling amount. And consequently, the adjusters 500 and 600 do not have to be used, or may be in other shapes.

Note that, the polarization coupling amount refers to a transfer function S12 between antennas transmitting and receiving different polarizations.

The spacer 400 is provided so that the standing parts 220 of the reflector 200 are not directly connected to the partition plate 300 and the adjusters 500 and 600. Note that, the standing parts 220 of the reflector 200 are connected to the partition plate 300 and the adjusters 500 and 600 by capacitive coupling. This makes it possible to suppress occurrence of the white noise without deteriorating the intermodulation distortion characteristics.

However, the spacers 400 are not necessarily needed, and direct connection may be carried out in light of the intermodulation distortion characteristics, the white noise characteristics, and so forth.

Moreover, in the first exemplary embodiment, the partition plate 300-1 is provided with the spacers 400-1*a* and 400-1*b*, the partition plate 300-2 is provided with the spacers 400-2*a* and 400-2*b*, the adjuster 500 is provided with the spacers 400-3*a* and 400-3*b*, and the adjuster 600 is provided with the spacers 400-4*a* and 400-4*b*; however, each of the spacers 400-1*a*, 400-2*a*, 400-3*a*, 400-4*a* and 400-1*b*, 400-2*b*, 400-3*b*, 400-4*b* may be continuously configured to form a single spacer.

In the reflector 200, as shown in FIG. 2B, the planar part 210 has the width REF-W and the standing part 220 has the height REF-H. For example, the width REF-W of the planar part 210 is $0.7\lambda_0$, and the height REF-H of the standing part 220 is $0.15\lambda_0$.

Moreover, between the antenna 100 and the reflector 200, there is an interval DP-H. For example, the interval DP-H is $\frac{1}{4}\lambda_0$. Note that, $\lambda_0$ refers to a free-space wavelength for the frequency $f_0$ to be designed.

These dimensions are appropriately changeable in accordance with required directional characteristics or the like of the array antenna 11.

The coupling part 330 of the partition plate 300 and the planar part 210 of the reflector 200 face each other with the interval PAR-G, and are not directly connected. Note that, the coupling part 330 of the partition plate 300 and the planar part 210 of the reflector 200 are connected by capacitive coupling. Consequently, without deteriorating the intermodulation distortion characteristics, similar to the case of the direct connection, it is possible to obtain good polarization coupling amounts over the wide band while suppressing occurrence of the white noise.

Obtaining of the good polarization coupling amounts like this is caused by reduction of coupling amount between the adjacent antennas 100 due to the partition plate 300. For example, the interval PAR-G between the planar part 210 of the reflector 200 and the coupling part 330 of the partition plate 300 is $0.02\lambda_0$. The interval PAR-G may be appropriately adjusted based on the required polarization coupling amounts or the like.

Note that, in the first exemplary embodiment, the dipole antenna was shown as the antenna 100; however, the antenna is not limited thereto, and may be in the shape of a patch antenna, a slot antenna, or the like.

For example, in the case of a rectangular patch antenna, a method of serving as a dual polarization antenna with a single element is often used by being fed from each of two sides of different lengths.

Moreover, in the case of a slot antenna, slot antennas that transmit and receive radio frequencies of different polarizations may be provided, or a cross slot antenna in the shape of a cross may be used to serve as a dual polarization antenna by being fed from different two points.

Figure 3A:
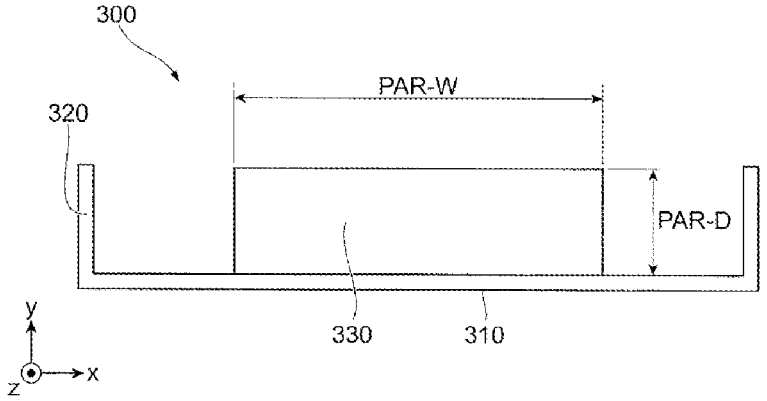
FIG. 3A and FIG. 3B show detailed views of a partition plate.
Figure 3B:
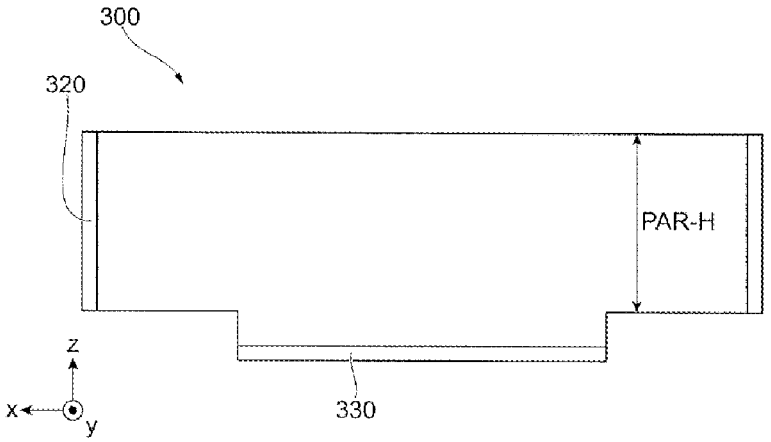

FIG. 3A and FIG. 3B show detailed views of the partition plate 300. FIG. 3A is an elevational view from the +z direction, and FIG. 3B is a side view from the +y direction. The partition plate 300 includes: the partition part 310; the two connecting parts 320 provided at both ends of the partition part 310 to be connected to the standing parts 220 of the reflector 200; and the coupling part 330 facing the planar part 210 of the reflector 200.

Here, as described above, the partition plate 300 is configured by bending the conductive material in the plate shape. The coupling part 330 is in a rectangular shape bent in the +y direction with respect to the partition part 310. The connecting part 320 of the partition plate 300 is in a rectangular shape bent in the +y direction with respect to the partition part 310.

Note that, as shown in FIG. 3B, the partition part 310 includes notches in the −z direction at the end portions in the ±x direction, but does not have to include any notch.

Here, the partition part 310 of the partition plate 300 has the height PAR-H in the z direction. Moreover, the coupling part 330 of the partition plate 300 has the width PAR-W in the x direction and the depth PAR-D in the y direction.

By providing the partition part 310 between the adjacent antennas 100, the polarization coupling amount between the dipole antenna 110 transmitting and receiving the radio frequencies of +45° polarization and the dipole antenna 120 transmitting and receiving the radio frequencies of −45° polarization is improved, and the effect is maximized when the partition plate 300 and the planar part 210 are directly connected. However, when the direct connection is performed, the intermodulation distortion or the white noise occurs from the connection portion in some cases.

On the other hand, in the first exemplary embodiment, by disposing the coupling part 330 of the partition plate 300 to face the planar part 210 of the reflector 200, the coupling part 330 of the partition plate 300 and the planar part 210 of the reflector 200 are capacitively coupled, and thereby, similar to the case of performing the direct connection, which will be described later, it is possible to obtain good polarization coupling characteristics over the wide band.

Note that, in the first exemplary embodiment, it is assumed that the height PAR-H of the partition part 310 is $0.1\lambda_0$, the width PAR-W of the coupling part 330 is $0.4\lambda_0$, and the depth PAR-D of the coupling part 330 is $0.1\lambda_0$. However, these dimensions are not necessarily limited thereto, and may be appropriately adjusted based on the frequency band to be needed, the required polarization coupling amounts, and the like.

Figure 4A:
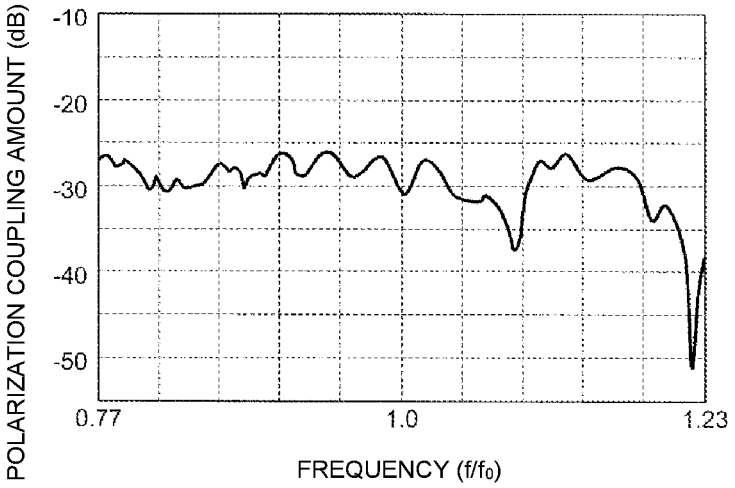
FIG. 4A and FIG. 4B show measurement values of the polarization coupling amount.
Figure 4B:
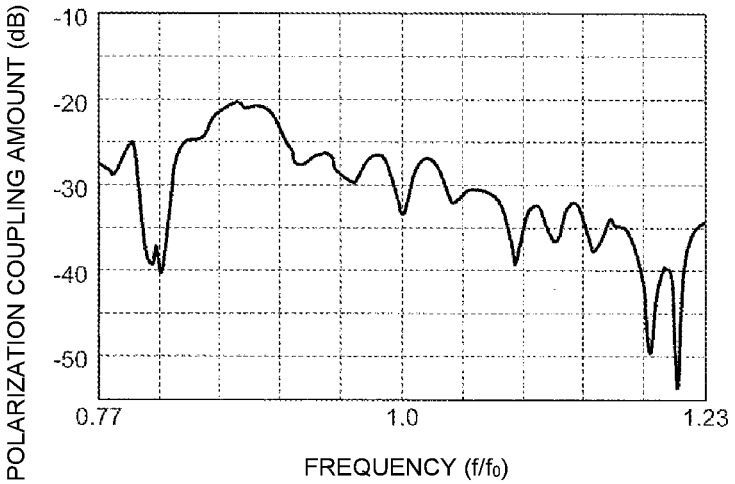

FIG. 4A and FIG. 4B show measurement values of the polarization coupling amount. FIG. 4A shows the polarization coupling amount in the first exemplary embodiment, and FIG. 4B shows the polarization coupling amount when the first exemplary embodiment is not adopted, and thereby the partition plate 300 is not provided with the coupling part 330. In FIG. 4A and FIG. 4B, the horizontal axis indicates the normalized frequency ($f/f_0$) and the vertical axis indicates the polarization coupling amount (dB). Note that, the frequency $f_0$ is set at 2 GHz band.

The polarization coupling amount shown here is, in the array antenna 11 having the numerical values shown as an example in the above, the transfer function S12 measured between the dipole antenna 110 transmitting and receiving the radio frequencies of +45° polarization and the dipole antenna 120 transmitting and receiving the radio frequencies of −45° polarization in each antenna 100.

The maximum value of the polarization coupling amount in the first exemplary embodiment shown in FIG. 4A is about −26 dB. In contrast thereto, the maximum value of the polarization coupling amount when the first exemplary embodiment shown in FIG. 4B is not adopted (in the case where the partition plate 300 is not provided with the coupling part 330) is about −20 dB. In other words, it is learned that, in the first exemplary embodiment, the maximum value of the polarization coupling amount is improved by about 6 dB and the polarization coupling amount is kept low over the wide band.

This represents that, as a result of increasing the coupling amount of the partition plate 300 and the planar part 210 of the reflector 200 by providing the coupling part 330 to the partition plate 300, the similar effect as the case when the partition plate 300 and the planar part 210 of the reflector 200 was directly connected can be obtained.

Other Exemplary Embodiments

Here, modified examples of the partition plate 300 will be described. Since the other configurations are similar to those of the first exemplary embodiment, explanations of the similar parts are omitted, and different parts will be described.

Figure 5A:
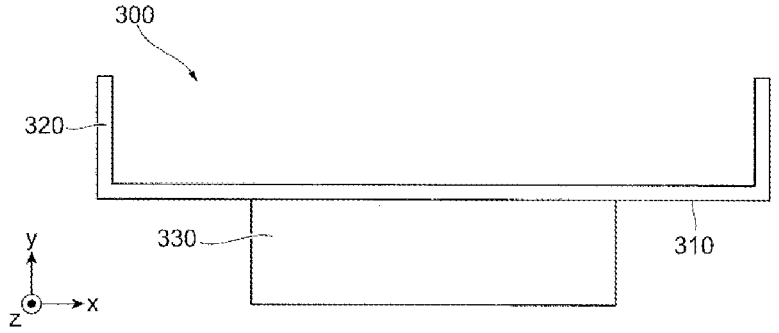
FIG. 5A, FIG. 5B and FIG. 5C show elevational views of modified examples of the partition plate.
Figure 5B:
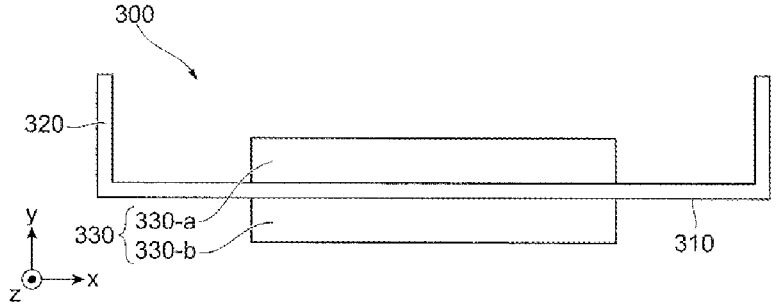
Figure 5C:
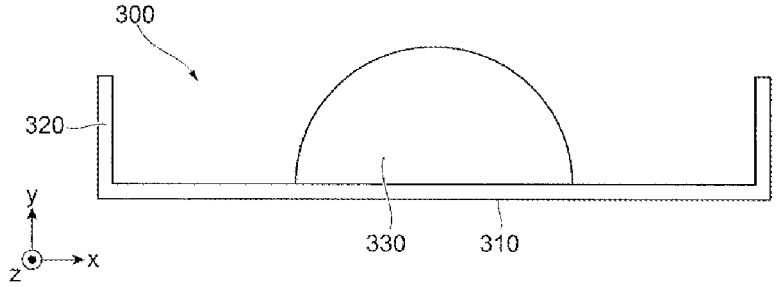

FIG. 5A, FIG. 5B and FIG. 5C show elevational views of modified examples of the partition plate 300. FIG. 5A shows a case in which the coupling part 330 is provided in the −y direction side with respect to the partition part 310, FIG. 5B shows a case in which the coupling part 330 is provided over the +y direction side and the −y direction side with respect to the partition part 310, and FIG. 5C shows a case in which the coupling part 330 is provided in a semicircular shape in the +y direction with respect to the partition part 310. Note that the side views of these partition plates 300 are similar to FIG. 3B.

As shown in FIG. 3A, in the first exemplary embodiment, the coupling part 330 provided to the partition plate 300 was provided in the rectangular shape in the +y direction with respect to the partition part 310.

In the partition plate 300 shown in FIG. 5A, the coupling part 330 is provided in the −y direction with respect to the partition part 310, which is opposite to the direction in the first exemplary embodiment.

Moreover, in the partition plate 300 shown in FIG. 5B, different from the first exemplary embodiment, the coupling part 330 (coupling parts 330-*a* and 330-*b*) is provided on both sides, in the +y direction and in the −y direction, of the partition part 310. In this case, it may be possible that, for example, the coupling part 330-*a* is configured as a structure integrated with the partition part 310 by sheet metal working, and the coupling part 330-*b* produced as a different member is screwed to the partition part 310 and the coupling part 330-*a*.

Further, in the partition plate 300 shown in FIG. 5C, the coupling part 330 is in a semi-circular plate shape.

In this manner, the coupling part 330 in the partition plate 300 may be in any shape or position to be provided as long as a structure in which the planar part 210 of the reflector 200 and the partition plate 300 can be capacitively coupled is provided.

Note that, in this specification, the dual polarization antenna transmitting and receiving the radio frequencies of ±45-degree polarization was described as a dual polarization antenna; however, the orientation of polarization is not limited thereto, and a dual polarization antenna combining a vertical polarization antenna and a horizontal polarization antenna may be used.

Moreover, to improve the directional characteristics, parasitic elements may be provided appropriately.

Moreover, when an array antenna transmitting and receiving radio frequencies of circular polarization is configured, two antennas for intersecting polarizations are fed with phase difference of 90 degrees in some cases; however, even in such cases, by using the partition plate 300 of the first exemplary embodiment and other exemplary embodiments, it is possible to improve circular polarization characteristics.

The invention claimed is:

1. An array antenna, comprising:

a first conductive member, including a planar part;

a plurality of antennas, arranged at a predetermined first interval to the planar part of the first conductive member, each of the plurality of antennas transmitting and receiving radio frequencies of a first polarization and radio frequencies of a second polarization that is different from the first polarization; and a second conductive member, provided between the antennas adjacent to each other among the plurality of antennas via a gap of a predetermined second interval to the planar part of the first conductive member, the second conductive member being capacitively coupled to the first conductive member, wherein the second conductive member comprises:

a partition part, including a plane included in a virtual flat plane that intersects the planar part of the first conductive member; and a coupling part, including a plane facing the planar part of the first conductive member via the gap of the predetermined second interval.

2. The array antenna according to claim 1, wherein in the second conductive member, the coupling part is provided closer to the first conductive member than the partition part.

3. The array antenna according to claim 2, wherein in the second conductive member, the coupling part and the partition part are configured by bending a conductive material.

4. The array antenna according to claim 3, wherein the first conductive member comprises, on a side intersecting a direction of arrangement of the plurality of antennas arranged at the predetermined first interval to the planar part, standing parts standing from the planar part toward a side where the plurality of antennas is arranged, and the second conductive member comprises, at end portions of the partition part, connecting parts that face the standing parts of the first conductive member, the connecting parts of the second conductive member being fastened to the standing parts of the first conductive member via an insulator material.

5. The array antenna according to claim 4, wherein the radio frequencies transmitted and received by the plurality of antennas are polarization of +45° direction and polarization of −45° direction with respect to the arrangement of the plurality of antennas.

6. The array antenna according to claim 3, wherein the radio frequencies transmitted and received by the plurality of antennas are polarization of +45° direction and polarization of −45° direction with respect to the arrangement of the plurality of antennas.

7. The array antenna according to claim 2, wherein the first conductive member comprises, on a side intersecting a direction of arrangement of the plurality of antennas arranged at the predetermined first interval to the planar part, standing parts standing from the planar part toward a side where the plurality of antennas is arranged, and the second conductive member comprises, at end portions of the partition part, connecting parts that face the standing parts of the first conductive member, the connecting parts of the second conductive member being fastened to the standing parts of the first conductive member via an insulator material.

8. The array antenna according to claim 7, wherein the radio frequencies transmitted and received by the plurality of antennas are polarization of +45° direction and polarization of −45° direction with respect to the arrangement of the plurality of antennas.

9. The array antenna according to claim 2, wherein the radio frequencies transmitted and received by the plurality of antennas are polarization of +45° direction and polarization of −45° direction with respect to the arrangement of the plurality of antennas.

10. The array antenna according to claim 1, wherein in the second conductive member, the coupling part and the partition part are configured by bending a conductive material.

11. The array antenna according to claim 10, wherein the first conductive member comprises, on a side intersecting a direction of arrangement of the plurality of antennas arranged at the predetermined first interval to the planar part, standing parts standing from the planar part toward a side where the plurality of antennas is arranged, and the second conductive member comprises, at end portions of the partition part, connecting parts that face the standing parts of the first conductive member, the connecting parts of the second conductive member being fastened to the standing parts of the first conductive member via an insulator material.

12. The array antenna according to claim 11, wherein the radio frequencies transmitted and received by the plurality of antennas are polarization of +45° direction and polarization of −45° direction with respect to the arrangement of the plurality of antennas.

13. The array antenna according to claim 10, wherein the radio frequencies transmitted and received by the plurality of antennas are polarization of +45° direction and polarization of −45° direction with respect to the arrangement of the plurality of antennas.

14. The array antenna according to claim 1, wherein the first conductive member comprises, on a side intersecting a direction of arrangement of the plurality of antennas arranged at the predetermined first interval to the planar part, standing parts standing from the planar part toward a side where the plurality of antennas is arranged, and the second conductive member comprises, at end portions of the partition part, connecting parts that face the standing parts of the first conductive member, the connecting parts of the second conductive member being fastened to the standing parts of the first conductive member via an insulator material.

15. The array antenna according to claim 14, wherein the radio frequencies transmitted and received by the plurality of antennas are polarization of +45° direction and polarization of −45° direction with respect to the arrangement of the plurality of antennas.

16. The array antenna according to claim 1, wherein the radio frequencies transmitted and received by the plurality of antennas are polarization of +45° direction and polarization of −45° direction with respect to the arrangement of the plurality of antennas.

17. The array antenna according to claim 1, wherein the radio frequencies transmitted and received by the plurality of antennas are polarization of +45° direction and polarization of −45° direction with respect to the arrangement of the plurality of antennas.

18. A sector antenna, comprising:

an array antenna that comprises:

a first conductive member including a planar part;

a plurality of antennas arranged at a predetermined first interval to the planar part of the first conductive member, each of the plurality of antennas transmitting and receiving radio frequencies of a first polarization and radio frequencies of a second polarization that is different from the first polarization;

a circuit that distributes and combines power for the plurality of antennas; and a second conductive member provided between the antennas adjacent to each other among the plurality of antennas via a gap of a predetermined second interval to the planar part of the first conductive member, the second conductive member being capacitively coupled to the first conductive member; and a cover that covers the array antenna, wherein the second conductive member comprises:

a partition part, including a plane included in a virtual flat plane that intersects the planar part of the first conductive member; and a coupling part, including a plane facing the planar part of the first conductive member via the gap of the predetermined second interval.

* * * * *